US010016903B2

(12) United States Patent
McCambridge et al.

(10) Patent No.: US 10,016,903 B2
(45) Date of Patent: Jul. 10, 2018

(54) HAIR CLIPPER COMB WITH MAGNETIC ATTACHMENT

(71) Applicant: Wahl Clipper Corporation, Sterling, IL (US)

(72) Inventors: James E. McCambridge, Lake Panasoffkee, FL (US); Luther D. Langley, Neeses, SC (US)

(73) Assignee: WAHL CLIPPER CORPORATION, Sterling, IL (US)

( * ) Notice: Subject to any disclaimer, the term of this patent is extended or adjusted under 35 U.S.C. 154(b) by 144 days.

(21) Appl. No.: 14/291,780

(22) Filed: May 30, 2014

(65) Prior Publication Data

US 2014/0352158 A1 Dec. 4, 2014

Related U.S. Application Data

(60) Provisional application No. 61/828,917, filed on May 30, 2013.

(51) Int. Cl.
*B26B 19/20* (2006.01)
*B26B 19/06* (2006.01)
*A45D 26/00* (2006.01)

(52) U.S. Cl.
CPC ..... *B26B 19/06* (2013.01); *A45D 26/00* (2013.01); *B26B 19/20* (2013.01)

(58) Field of Classification Search
CPC . B26B 21/12; B26B 21/2025; B26B 21/4018; B26B 21/40; B26B 19/3813
USPC ..... 30/77–79, 200, 233.5
See application file for complete search history.

(56) References Cited

U.S. PATENT DOCUMENTS

| | | | | |
|---|---|---|---|---|
| 1,628,421 | A | 5/1927 | Patenaude | |
| 3,344,520 | A * | 10/1967 | Williams | 30/200 |
| 3,660,894 | A * | 5/1972 | Sand | B26B 21/16 30/74 |
| 3,872,586 | A * | 3/1975 | Oguchi | 30/43.91 |
| 5,188,332 | A * | 2/1993 | Callas | G09F 7/18 248/206.5 |
| 6,243,955 | B1 * | 6/2001 | Forbers et al. | 30/233.5 |
| 7,337,903 | B2 * | 3/2008 | Lauri | 206/350 |

(Continued)

FOREIGN PATENT DOCUMENTS

WO 2005049288 6/2005

*Primary Examiner* — Andrea Wellington
*Assistant Examiner* — Fernando Ayala
(74) *Attorney, Agent, or Firm* — Greer, Burns & Crain, Ltd.

(57) ABSTRACT

An attachment comb is provided for a hair clipper, and includes a comb body having a leading edge and an attachment edge, a blade-engaging surface and an opposite outer surface, and a plurality of teeth projecting from the leading edge. Sidewalls on the comb body project from the body, and at least one of the sidewalls defines a magnet opening. The blade-engaging surface has a magnet recess located adjacent a corresponding magnet opening, the magnet recess defining a magnet pocket. A magnet has a peripherally projecting base flange and is constructed and arranged for insertion through the magnet opening and such that the flange is insertable into the recess and the magnet is disposed in the magnet pocket so that a blade contacting surface of the magnet is in direct contact with a corresponding clipper blade upon assembly of the comb upon a clipper blade.

13 Claims, 6 Drawing Sheets

(56) References Cited

U.S. PATENT DOCUMENTS

| | | | | |
|---|---|---|---|---|
| 2009/0019706 | A1* | 1/2009 | Werner et al. | 30/233.5 |
| 2009/0044411 | A1* | 2/2009 | Cotant | 30/233.5 |
| 2013/0219724 | A1* | 8/2013 | Werner | 30/201 |

* cited by examiner

HAIR CLIPPER COMB WITH MAGNETIC ATTACHMENT

RELATED APPLICATION

This application claims Section 119 priority from U.S. 61/828,917 filed May 30, 2013.

BACKGROUND

The present invention relates generally to attachment combs used with powered hair clippers and trimmers for regulating the length of hair retained by a customer after the hair is cut. More specifically, the present invention relates to an attachment comb configured for being magnetically secured to the clipper blade.

Attachment combs are commonly used with powered hair cutting devices such as clippers or trimmers collectively referred to as hair clippers. Conventional hair clippers often are supplied with multiple attachment combs of varying sizes. Each size of comb has a plurality of teeth, and the length of the teeth vary from comb to comb, and all combs of a set typically attach to the clipper near the blades using a snap or friction fit provided by clips or tabs. An operator typically changes attachment combs several times over the course of a haircut or hair styling event, depending on the desired length of hair. It is common for the clips of conventional attachment combs to break, rendering the particular comb unable or difficult to attach to the corresponding clipper blade.

As a result, attachment combs are known which are attached to the respective hair clipper blade using magnets. Examples of such combs are described in U.S. Pat. No. 3,344,520 and US Patent Publication No. 2009/0019706. However, such combs have operational defects or have otherwise not been commercially accepted. One reason is that heat is known to deenergize magnets. A common operational aspect of hair clippers is that the blades become relatively hot during use, and this heat has been found to reduce the holding power of the magnets in conventional combs, causing the combs to detach from the blades during clipping. Naturally, this problem causes inefficiencies in the hair clipping operation, which hair care professionals wish to avoid.

Another problem with conventional hair clipper attachment combs having magnets is that the configuration of the clipper blade to which the comb is attached varies between clipper models, and between clippers produced by a variety of manufacturers. As such, conventional magnetically attached combs have not been securely held on the blades due to the positioning of the magnet on the comb body. Such positioning may be acceptable for some clipper blades, but is not universally acceptable over a variety of clipper blades.

Accordingly, there exists a need for an improved attachment comb that is magnetically attached to the clipper blade.

SUMMARY

The present comb meets or exceeds the above-listed need. Specifically, the present device incorporates magnets into the base or body of the clipper comb so that the magnets are easily replaced by the user once their holding power is reduced due to extended use. Another feature of the present comb is that the magnet is held in the comb body in a way which permits some floating action of the magnet, due to dimensions of the body that permit movement of the magnet, but do not permit the magnet to easily become detached from the comb body, to adapt to a wider variety of blade configurations than conventional magnetically attached combs. More specifically, the magnet is preferably held in the comb only by a plurality of spaced projections at the magnet opening, and by a slidable engagement between a magnet flange and an accommodating slot in a magnet recess. As a result, the present comb is more securely held on the clipper blade than conventional models. Further, the magnet is easily replaced by the user by causing minor flexing of the comb base, which releases the locking formations that retain the magnet in a magnet recess during clipper operation. Another feature of the present comb is that the magnet is directly in contact with the blade, and is configured for increased "face contact" for facilitating gripping and enhancing the fastening action of the magnet. As a result, the present comb is subject to reduced vibration upon installation on the clipper, compared with conventional magnetically-secured attachment combs.

In addition, in the present comb, the magnet is not fixed to the comb body, but instead floats to a certain extent relative to the comb and is held in place by formations of comb body. Specifically, a recess in the comb body receives a base flange of the magnet. The magnet is passed through an opening ire a sidewall of the comb for engaging the recess. A magnet pocket is defined by the recess defines a magnet pocket, which receives the magnet. In addition, at least one depending lug formation defining the opening prevents escape of the magnet from the recess. Also, the opening is configured for engaging a flange on the magnet, assisting the lugs in preventing the escape of the magnet from the magnet pocket.

More specifically, an attachment comb is provided for a hair clipper, and includes a comb body having a leading edge and an opposite attachment edge, a blade engaging surface and an opposite outer surface, and a plurality of teeth projecting from the leading edge. Sidewalls on the comb body project from a plane defined by the body, and at least one of the sidewalk defines a magnet opening near an intersection of the sidewall and a corresponding edge of the comb body. The blade-engaging surface has a magnet recess located adjacent a corresponding magnet opening, the magnet recess defining a magnet pocket. A magnet has a peripherally projecting base flange and is constructed and arranged for insertion through the magnet opening and such that the flange is insertable into the recess and the magnet is disposed in the magnet pocket so that a blade contacting surface of the magnet is in direct contact with a corresponding clipper blade upon assembly of the comb upon a clipper blade.

In another embodiment, a magnet is provided for use with an attachment comb for a hair clipper, the comb including a comb body having a leading edge and an opposite attachment edge, a blade engaging surface and an opposite outer surface, a plurality of teeth projecting from the leading edge, sidewalk on the comb body projecting from a plane defined by the body, at least one of the sidewalls defining a magnet opening, the blade-engaging surface having a magnet recess located adjacent a corresponding magnet opening, the magnet recess defining a magnet pocket. The magnet includes a generally rectangular box-shaped main magnet body having a peripherally projecting base flange projecting from one end of the body and constructed and arranged for insertion through the magnet opening and such that the flange is insertable into the recess and the magnet is disposed in the magnet pocket so that a blade contacting surface of the magnet is in direct contact with a corresponding clipper blade upon assembly of the comb upon a clipper blade.

DETAILED DESCRIPTION

Figure 1:
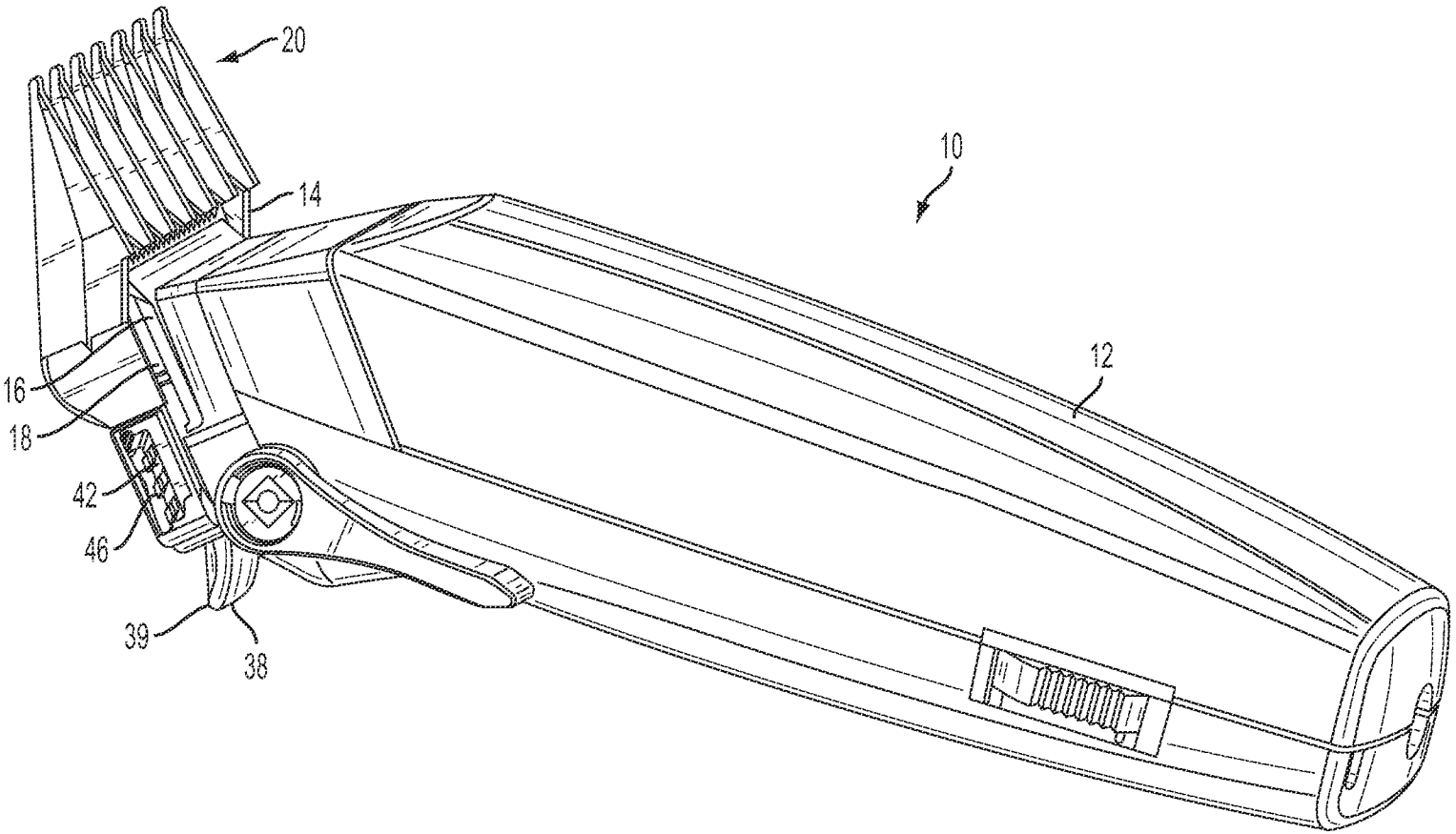
FIG. 1 is a side perspective view of the present attachment comb mounted upon a hair clipper.

Referring now to FIG. 1, a conventional hair clipper is generally designated 10, and includes a clipper housing 12 to which is attached a bladeset 14 having a laterally reciprocating toothed moving blade 16 and a toothed stationary blade 18. As is well known in the hair clipper art, scissors-like cutting action is achieved through the movement of the moving blade 16 relative to the stationary blade 18. The present attachment comb, generally designated 20, is shown attached to the bladeset 14, and specifically to the stationary blade 18. As will be described below, besides engagement with the bladeset 14 as is known in the art, the comb 20 is secured in place on the stationary blade 18 solely by magnetic attraction.

Referring now to FIGS. 2-6, the present comb 20 is shown in greater detail, and includes a generally planar comb body 22 having a leading edge 24 and an opposite attachment edge 26, a blade engaging surface 28 and an opposite outer surface 30. As is well known in the hair clipper art, a plurality of spaced, generally parallel teeth 32 project from the leading edge 24. A pair of sidewalls 34 is provided on the comb body 22 and project from a plane defined by the body. While in the preferred embodiment, the sidewalls 34 project generally normally from the body 22, other arrangements are contemplated. Also it will be seen that the sidewalls 34 are preferably continuous with outermost teeth 36 on the comb 20.

An optional finger tab 38 extends from the attachment edge 26 and defines an angle relative to the outer surface 30. The finger tab 38 is provided for facilitating removal of the comb 20 from the bladeset 14, and also has a free edge 39 that is sufficiently wide for laterally supporting the clipper 10 against wobbling when placed on a substrate, such as a table (FIG. 1). In addition, the tab 38 is dimensioned with a sufficient length to place the bladeset 14 above the substrate, as seen in FIG. 1. A feature of the tab 38 is that it makes the clipper 10 easier for a user to pick up, especially when the user is a hair care professional, because the clipper position on the substrate is consistent. Also, a size-indicative designator 40, such as a number, is optionally placed on the comb body 22, as by integrally forming a number-shaped aperture during molding.

Figure 2:
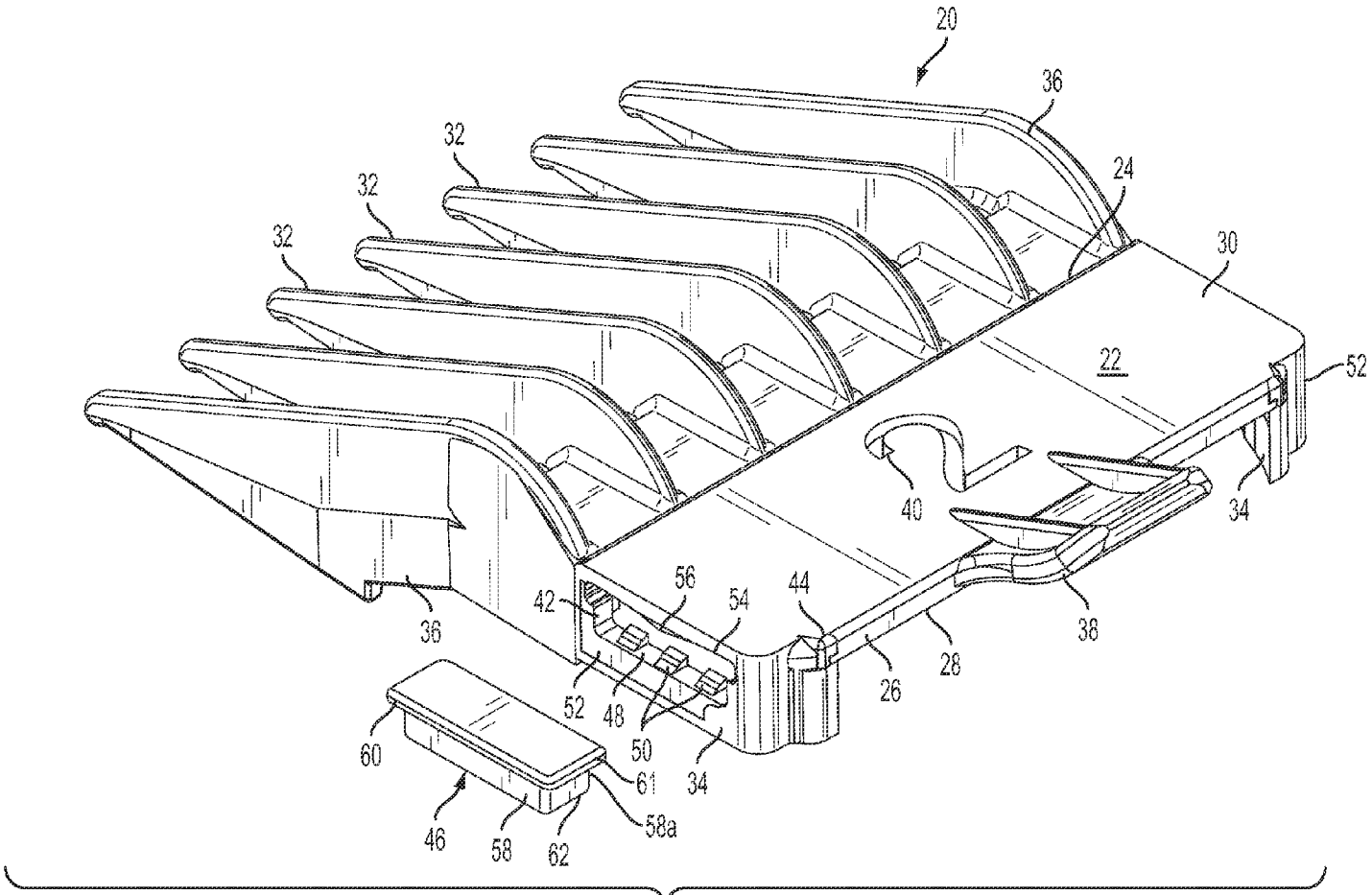
FIG. 2 is a top perspective view of the present attachment comb with a magnet shown exploded therefrom.
Figure 3:
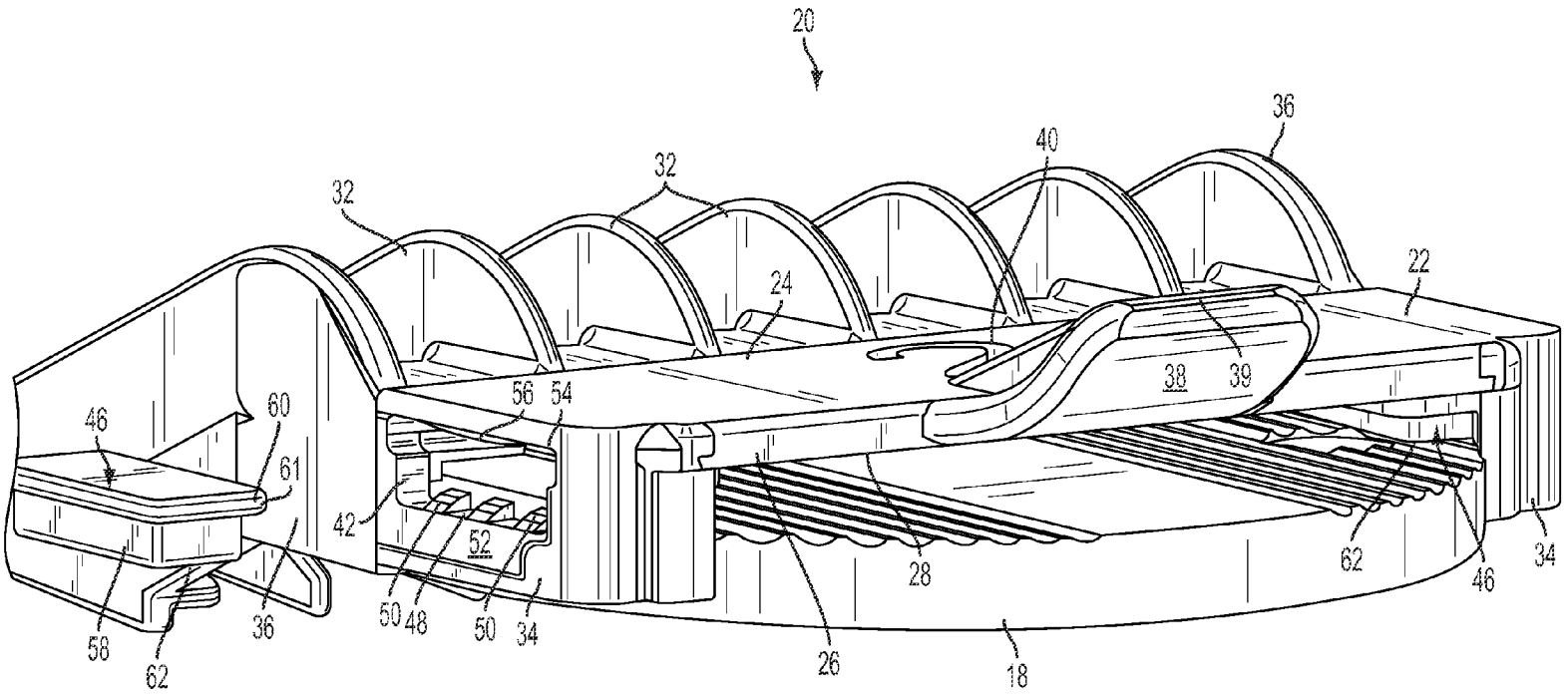
FIG. 3 is a rear perspective view of the comb of FIG. 2.
Figure 4:
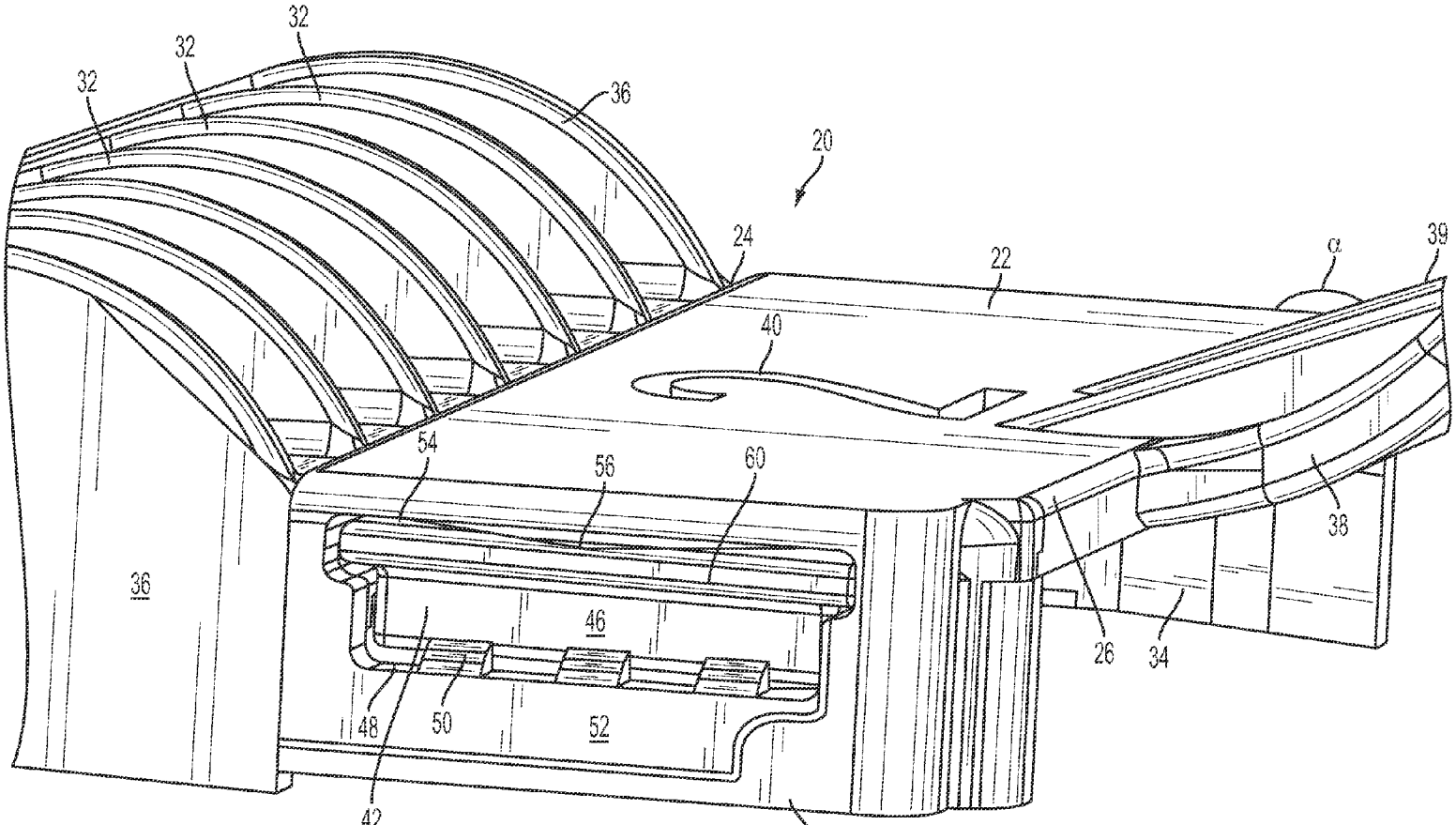
FIG. 4 is an enlarged fragmentary side perspective view of the comb of FIG. 2.

Referring now to FIGS. 2-4, at least one and preferably both of the sidewalls 34 define a magnet opening 42 near an intersection of the sidewall and a corresponding edge 44 of the comb body 22. Generally speaking, the magnet opening 42 is generally "T"-shaped when viewed from the side of the comb (FIG. 2), and is dimensioned for slidably accommodating and releasably retaining a magnet, generally designated 46, and described in greater detail below. A first edge 48 of the magnet opening 42 is provided with a plurality of spaced projections 50, each a lug that is preferably inclined so that they taper downward toward an outer surface 52 of the sidewall 34. The projections extend into the magnet opening 42 for releasably retaining the magnet. Opposite the first edge 48, a second magnet opening edge 54 defines wedge shape 56 generally pointed toward the opening 42, and also toward the projections 50. This wedge shape 56 slightly reduces the area of the magnet opening 42 so that the magnet 46 cannot easily slide through the opening after installation, as described below.

The magnet 46 has a generally mere tangy lady box-shaped main magnet body 58, preferably including opposed pairs of planar long and short sides, as well as a planar rectangular top and bottom surfaces, and also has a peripherally projecting base flange 60 projecting from one end (top or bottom) or large planar rectangular surface 58*a* of the body, and is constructed and arranged for insertion through the magnet opening 42. Also, the magnet is preferably provided with a radiused exterior edge 61. It will be seen in FIGS. 2 and 3 that the magnet opening 42 generally corresponds to the profile of the magnet 46, including a portion dimensioned for accommodating the base flange 60. Also, the ramped nature of the projections 50 is such that the magnet 46 is relatively easily slid through the opening 42, but does not easily slide out. Once inserted through the magnet opening 42, a blade contacting surface 62 of the magnet 46 is in direct contact with the stationary blade 18 (FIG. 3).

Figure 5:
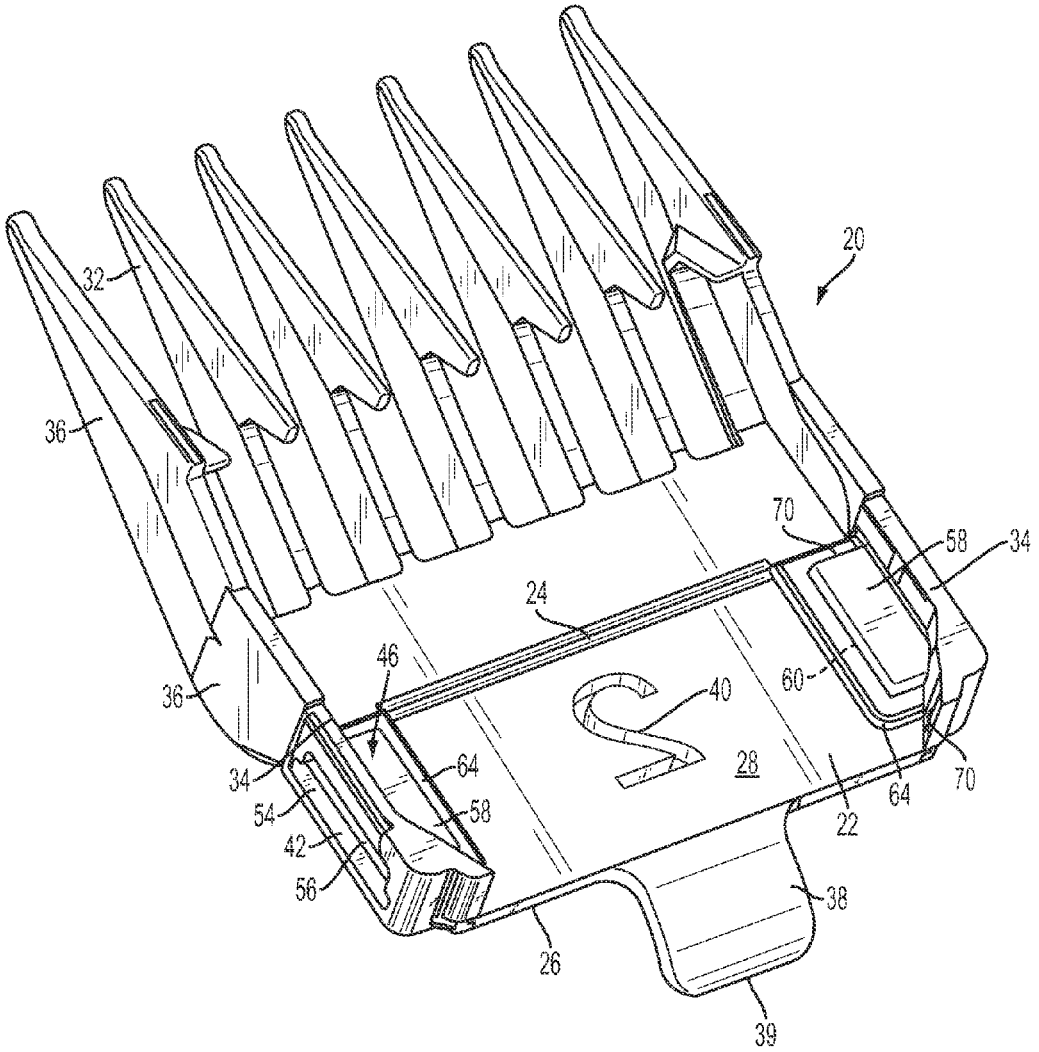
FIG. 5 is a bottom perspective view of the present attachment comb.
Figure 6:
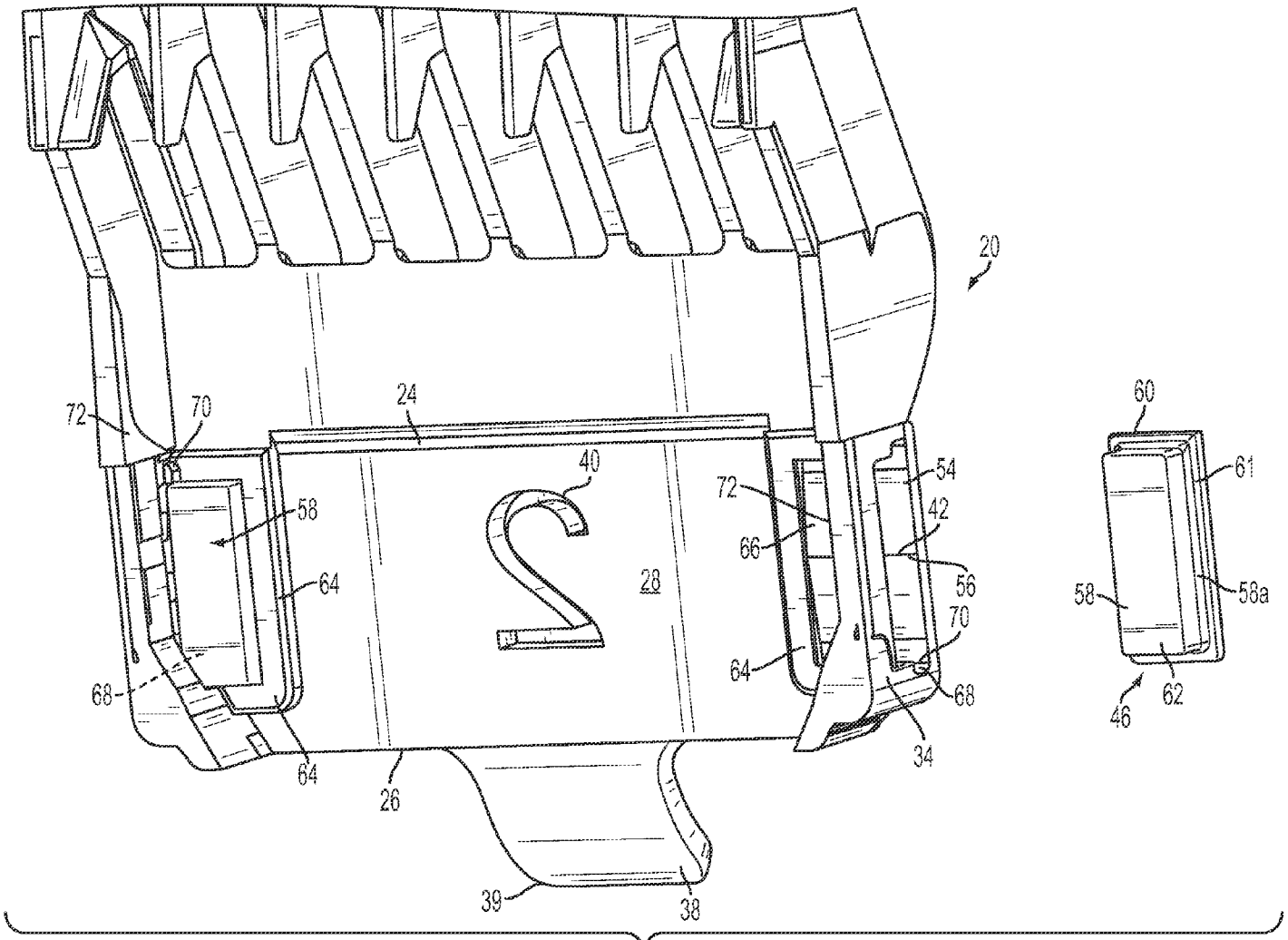
FIG. 6 is an enlarged fragmentary exploded perspective view of the comb of FIG. 5.

Referring now to FIGS. 5 and 6, the blade-engaging surface 28 of the comb body 22 has a magnet recess 64 located adjacent a corresponding magnet opening 42, preferably on the same surface as the second magnet opening edge, and the magnet recess defines a magnet pocket 66. The magnet recess 64 defines a slot 68 opening toward the magnet pocket and dimensioned for slidably accommodating the magnet flange 60. In the preferred embodiment, the magnet recess 64 is generally "["-shaped when viewed from above (FIGS. 5 and 6), and ends 70 of the recess are connected to corresponding inside surfaces 72 of the corresponding sidewall 34. Thus, the slot 68 extends about all three segments of the recess 64. The magnet pocket 66 receives an opposite surface of the magnet 46 from the blade-contacting surface 62.

In operation, the magnet 46 is insertable into the magnet opening 42 so that the magnet flange 60 is insertable into the magnet recess 64 and the magnet is disposed in the magnet pocket 66 so that the blade contacting surface 62 of the magnet is in direct contact with the corresponding stationary blade 18 upon assembly of the comb 20 upon the clipper blade.

The projections 50 and the wedge shape 56 hold the magnet 46 in the magnet pocket 66. This retention, with the engagement of the magnet flange 60 in the slot 68 is the only retention of the magnet in the magnet pocket 66. Thus, the magnet 46 is free to move or "float" to a certain extent within the magnet pocket 66 and thus accommodates variations in shape and contour of the stationary blade 18, while retaining significant "face" contact between the magnet and the blade for enhanced attracting force compared to conventional magnetically attached combs. Also, when the magnet 46 loses its magnetic power, the sidewall 34 is sufficiently flexible that a user can readily manipulate the magnet 46 through the magnet opening by flexing the sidewall, and remove the magnet so that it can be replaced with a fresh one.

While a particular embodiment of the present hair clipper comb with magnetic attachment has been shown and described, it will be appreciated by those skilled in the art that changes and modifications may be made thereto without departing from the invention in its broader aspects and as set fourth in the following claims.

What is claimed is:

1. An attachment comb for a hair clipper, comprising:

a comb body having a leading edge and an opposite attachment edge, a blade engaging surface and an opposite outer surface, a plurality of teeth projecting from said leading edge;

sidewalls on said comb body projecting generally normally from a plane defined by said body, said sidewalls being continuous with outer surfaces of outermost teeth of said plurality of teeth;

at least one of said generally normally projecting sidewalls defining a magnet opening in said sidewall so that said magnet opening is generally coplanar with said outer surfaces of the outermost teeth;

said blade-engaging surface having a magnet recess located adjacent and normal to a corresponding said magnet opening, said magnet recess defining a magnet pocket; and a unitary magnet having a body, at least one planar rectangular surface and a peripherally projecting base flange so that said magnet forms a general "T"-shape profile when viewed from a side, said magnet constructed and arranged for insertion through said magnet opening transverse to a direction said teeth project from said leading edge, and such that said flange is insertable into said recess and said magnet is disposed in said magnet pocket so that a blade contacting surface of said magnet is in direct contact with a corresponding clipper blade upon assembly of said comb upon a clipper blade, said magnet body and said at least one planar rectangular surface being generally coplanar with said outer surfaces of said outermost teeth; and said magnet opening having a complementary "T"-shape that corresponds to said profile of said magnet.

2. The comb of claim 1 wherein said magnet opening is partially defined by projections extending into said opening for releasably retaining said magnet in said magnet pocket.

3. The comb of claim 2 wherein said projections are a plurality of spaced lugs depending from an edge of said magnet opening.

4. The comb of claim 1 wherein said magnet opening is constructed and arranged so that at least one edge is provided with a wedge shape for engaging said magnet flange for retaining said magnet in said magnet pocket.

5. The comb of claim 2 further including an edge of said magnet opening opposite said projections having a wedge shape for engaging said magnet flange for retaining said magnet in said magnet pocket.

6. The comb of claim 1 wherein said magnet opening is near an intersection of said sidewall and a corresponding edge of said comb body.

7. The comb of claim 1 wherein ends of said magnet recess contact an inner surface of said sidewall.

8. The comb of claim 1 including a pair of said generally normally projecting sidewalls on said comb, each said sidewall having one of said magnet openings, a corresponding said magnet recess and said magnet pocket.

9. The comb of claim 1 wherein said sidewalls are each sufficiently flexible such that manipulation by a user permits replacement of said magnet held in said magnet pocket.

10. The comb of claim 1 including a finger tab extending from said attachment edge and defining an angle relative to said outer surface, said tab having a free end with a width sufficiently wide to laterally stabilize a hair clipper attached to said comb, when the clipper and comb assembly are placed on a substrate.

11. The comb of claim 1 wherein said magnet is retained in said magnet pocket only by engagement of said flange in said magnet recess and by formations defining said magnet opening, such that said magnet is retained in, but is movable within said magnet pocket.

12. An attachment comb for a hair clipper, comprising:

a comb body having a leading edge and an opposite attachment edge, a blade engaging surface and an opposite outer surface, a plurality of teeth projecting from said leading edge;

at least one sidewall on said comb body projecting normally from a plane defined by said body, said at least one sidewall being generally coplanar and continuous with outer surfaces of outermost teeth of said plurality of teeth;

at least one of said sidewalls defining a magnet opening, each said magnet opening being generally coplanar with said corresponding sidewall and said outer surfaces of said outermost teeth;

said blade-engaging surface having a magnet recess located adjacent a corresponding said magnet opening, said magnet recess defining a magnet pocket;

a magnet unitarily having a generally rectangular body and a peripherally projecting base flange so that said magnet appears to have a general "T"-shape profile when viewed from the side and said magnet being constructed and arranged for insertion through said magnet opening and such that said flange is insertable into said recess and said magnet is disposed in said magnet pocket so that a blade contacting surface of said magnet is in direct contact with a corresponding clipper blade upon assembly of said comb upon a clipper blade; and said magnet opening being complementary to said body, having a complementary "T"-shape that corresponds to said profile of said magnet, and said flange of said magnet and has a first edge that is partially defined by projections extending from said first edge into said opening for releasably retaining said magnet in said magnet pocket, said projections are a plurality of spaced lugs depending from an edge of said magnet opening; and an edge of said magnet opening parallel to said first edge and opposite said projections having a wedge shape projecting into said opening toward said projections for engaging said magnet flange for retaining said magnet in said magnet pocket.

13. The comb of claim 12 wherein each said lug is inclined to taper toward an outer surface of said sidewall.

* * * * *